United States Patent [19]

Frohling et al.

[11] 4,019,358

[45] Apr. 26, 1977

[54] ROLLING MILL

[75] Inventors: Josef Fröhling, Olpe, Biggesee; Karl Wiedemer, Siegen, both of Germany

[73] Assignee: Firm Josef Frohling, Olpe, Biggesee, Germany

[22] Filed: Sept. 30, 1975

[21] Appl. No.: 618,275

Related U.S. Application Data

[63] Continuation of Ser. No. 468,153, May 8, 1974, abandoned.

[30] Foreign Application Priority Data

May 10, 1973 Brazil ..... 3392/73

[52] U.S. Cl. ..... 72/189; 72/406; 72/407; 72/241

[51] Int. Cl.[2] ..... B21B 13/18

[58] Field of Search ..... 72/189, 190, 214, 215, 72/240, 241, 406, 407

[56] References Cited

UNITED STATES PATENTS

| | | | |
|---|---|---|---|
| 2,118,224 | 5/1938 | Pearson | 72/189 |
| 2,975,663 | 3/1961 | Platzer | 72/190 |
| 3,102,443 | 9/1963 | Dell et al. | 72/189 |
| 3,425,253 | 2/1969 | Saxl | 72/189 |
| 3,505,849 | 4/1970 | Grube | 72/215 |
| 3,625,042 | 12/1971 | Sendzimir | 72/189 |
| 3,635,065 | 1/1972 | Sendzimir | 72/241 |
| 3,789,646 | 2/1974 | Sendzimir | 72/240 |
| R12,515 | 7/1906 | Briede | 72/189 |

*Primary Examiner*—Lowell A. Larson
*Attorney, Agent, or Firm*—Fleit & Jacobson

[57] ABSTRACT

In a rolling mill for a metal workpiece and comprising a pair of rotary work rolls for reducing the thickness of the workpiece when it is fed therebetween, a carrier for at least one of the work rolls comprises a cam surface which can roll on a counterface provided on a backing member for the carrier. Means are provided for displacing the carrier, whereby the cam surface is rolled on the counterface of the backing member and the said one work roll is displaced to describe a path determined by the shapes of the cam surface and counterface. It is preferred that each work roll of the pair be supported by a separate displaceable carrier, each carrier having a cam surface which can roll on counterfaces of separate associated backing members.

31 Claims, 16 Drawing Figures

10
9
9
11
11
17
18
8
4
14
6
13
3
5
19
15
16
20
22
23
21
2
1
1
2
7
2'
1'
2'
21'
22'
15'
16'
20'
3'
5'
6'
14'
4'
19'
11'
17'
18'
11'
9'
9'
10'

Fig. 8
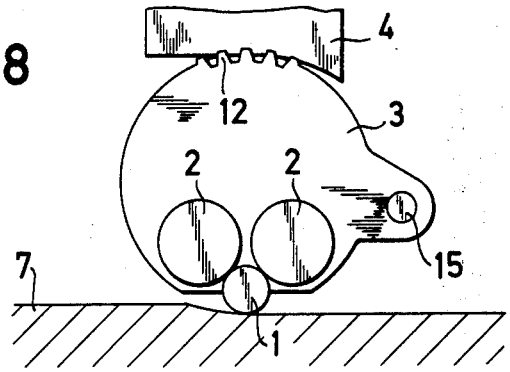
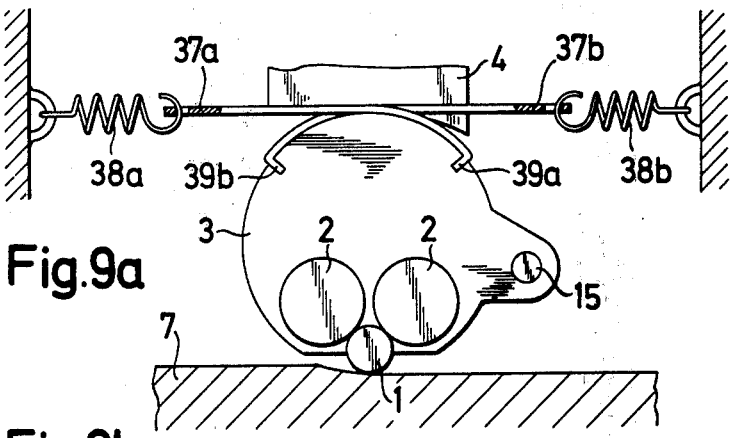
Fig. 9a
Fig. 9b
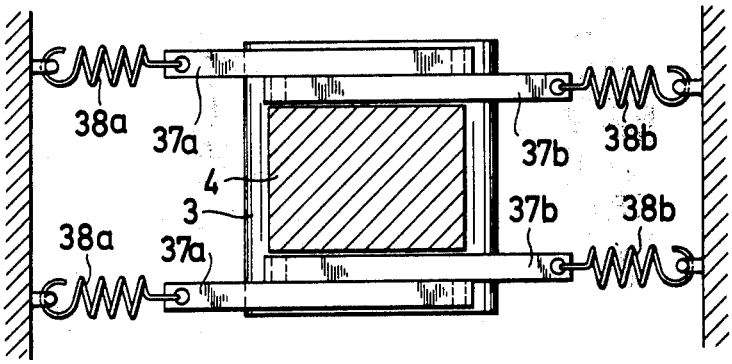

ROLLING MILL

This is a continuation application of Ser. No. 468,153 filed May 8, 1974, now abandoned.

The invention relates to a rolling mill and is particularly applicable to strip mills.

In all known rolling mills, the shafts of the work rolls are mounted in bearings which, for the purpose of setting the work rolls and/or oscillating the work rolls, are, in turn, linearly displaceable along slide rails of the roll stand and/or concentrically or eccentrically rotatable in shaft bearings. Such an arrangement of the work roll bearings gives rise to friction and consequent wear during their linear and/or rotary motion, and of course this wear is more intensive the more frequently the work roll bearings have to be moved and the longer and more complicated is the path that they have to traverse. For example, in the case of one rolling mill where the work rolls follow a course composed of an arcuate path followed by a rectilinear section, the work roll bearings have to be subjected to a combination of rotary and linear movement. This calls for complicated driving and transmission mechanisms and a large number of surfaces which are in frictional contact, so that the amount of wear is considerable and could lead to undesirable play of the moving parts, inaccurate motion of the work rolls, and possibly even faults in the mechanisms. For these reasons, rolling mills in which the work rolls execute compound movements composed of various components have not proved successful in practice.

The present invention aims to provide a rolling mill in which the work rolls can be set and/or oscillated during the rolling operation along any desired path with a minimum of resultant friction. Since friction will always occur where two surfaces are in sliding contact, the invention has been developed with a view to replacing sliding contact by rolling contact.

According to the invention, there is provided a rolling mill for a metal workpiece, particularly an elongated workpiece, comprising work rolls rotatably mounted in associated displaceable carriers in the form of rolling members, wherein each work roll is mounted in its associated rolling member so that its rotary axis is parallel to the geometrical central axis of the rolling member and its peripheral surface forms a continuation of the periphery of the rolling member, and wherein a peripheral surface portion of each rolling member opposite to where the work roll is located is disposed to roll on a backing surface of a pressure member for urging the respective work roll against the workpiece during the rolling operation.

The function of a rolling mill according to the invention can best be explained by considering the motion of a point on the periphery of a wheel that is rolling along a surface. For this purpose, reference will be made to FIGS. 1 to 6 of the accompanying drawings, in which each of these figures is a cross-sectional diagram. FIG. 1 illustrates a wheel 3 rolling along a surface 5 from a position *x* to a position *y*. During this travel, a point 1 on the circumference of the wheel describes a cycloidal path. If a point lying within the circumference of the wheel is considered, i.e. a point closer to the centre of the wheel, such a point will describe a sloped cycloidal path. A point beyond the wheel circumference (for example a point located on an extension arm) will describe an intertwined cycloidal path. In every case the path will be cycloidal. If, now, the point 1 is considered to be a work roll of a rolling mill and the integer 3 is considered to be a rolling support for this work roll, the principle of the present invention will become evident. Since the work roll will generally move along a cycloidal path during at least part of its movement, a rolling mill according to the invention has been termed a cycloidal rolling mill.

FIG. 2 illustrates a rolling carrier 3 for an upper work roll 1 and a rolling carrier 3' for a lower work roll 1'. The peripheral surfaces 6, 6' of the work roll carriers roll on respective backing surfaces 5, 5' of pressure members 4, 4' to a limited extent. In a central position of the carriers, the work rolls 1, 1' are pressed against the surfaces of the workpiece 7 that is to be rolled. In the two limiting positions to either side of the central position, the work rols 1, 1' are raised from the workpiece 7. During movement of the carriers from one limiting position to the other, the work rolls describe a cycloidal path.

In a cycloidal rolling mill it is not necessary that the peripheral surface areas 6, 6' of the carriers 3, 3' should be arcuate where they make contact with the pressure members 4, or that the backing surfaces 5, 5' of the pressure members be planar, in the manner shown in FIG. 2. In the preferred arrangement of FIG. 3, the surface regions 6, 6' of the work roll carriers 3, 3' are arcuate and the backing surfaces 5, 5' are planar only in an upstream region (as viewed in the direction of movement of the workpiece 7) and then curved towards the workpiece 7. This curvature can be chosen so that, during the rolling opertion, the work rolls 1, 1' execute compound cycloidal and linear motion. These and other compound movements of the work rolls may be desirable when it is intended to oscillate the work rolls to and fro during the rolling operation. The following explanation may help to clarify this.

In FIG. 4 the workpiece 7 is being fed from the left to the right hand side. If the upper work roll 1 is rapidly moved in the same direction, it will push a bead 36 of material in front of it, and of course the same applies to the lower work roll which is not shown in FIG. 4. If the work roll describes a true cycloidal path during its oscillation, as indicated by the line I—I' and finally lifts off the workpiece 7, then the bead 36 of material remains on the workpiece surface and the rolled workpiece will exhibit unevennesses caused by the beads or corrugations. However, if the work roll executes a stroke that is first cycloidal and then substantially linear and parallel to the workpiece surface, the work roll will effectively distribute the bead 36 over the workpiece surface so that the latter will be smooth and even as it leaves the rolling mill.

It is preferable if the downstream stroke of the work roll terminates at a position *e* at which the pressure of the work roll on the workpiece is relieved, i.e. where the work roll exerts only contact pressure on the workpiece but is no longer effective to cause plastic deformation of the workpiece. This means that at its downstream end of motion, the work roll must follow a short curved path directed away from the workpiece surface, the curvature of this final path preferably being more intense than the curvatuve of the cycloidal path at the upstream end of the work roll motion. Accordingly, the work roll will travel along a course indicated by the full line I–II in FIG. 4, the downstream end of the stroke of the work roll being indicated by the point *e* at the centre of the work roll. As already mentioned, this point *e* would be located at a position where, assuming that the roll frame is absolutely rigid, the work roll starts to lift off the workpiece surface. In practice, the roll frame will always have a certain amount of elasticity and consequently the work roll will continue to make contact with the workpiece in the limiting position but relieve the workpiece of pressures that cause plastic deformation.

The desired path for the work roll is achieved in practice with a rolling mill according to the invention by appropriately shaping each work roll carrier and the backing surface of the pressure member on which the carrier rolls. Referring to FIG. 5, if the peripheral portion 6, 6' of the carrier 3 making rolling contact with the backing surface 5, 5 of the pressure member 4 is circular cyclindrical, then the curved portion at the downstream end of the backing surface (as viewed in the direction in which the workpiece is fed) should first be directed towards the workpiece and finally away from the workpiece. Although FIG. 5 illustrates this condition only for the upper work roll carrier 3 and its associated pressure member, the same considerations apply to the lower work roll carrier.

As shown in FIG. 6, the same result as that achieved with the FIG. 5 construction can be obtained if the backing surface 5, 5' of the pressure member 4 is planar throughout and a portion *b* of the work roll carrier surface making contact with the backing surface during the downstream part of the work roll movement has a different curvature from that of a portion *a* that makes contact with the backing surface during the upstream part of the work roll movement. In fact, the portion *b* may have a first section $b_1$ of which the curvature is less than that of the portion *a* and a section $b_2$ of which the curvature is greater than that of the portion *a*.

By means of the invention, therefore, the surfaces 5, 5' of the pressure members 4, 4' and the surface portions 6, 6' of the work roll carriers 3, 3' can be shaped as may be desired so as to suit a particular rolling operation that is to be performed on a workpiece 7.

Whereas with hitherto known rolling mills compound curved motion of the work rolls could be achieved only with driving and transmission mechanisms that were subject to high friction and wear and prone to become defective and possibly produce inaccurately rolled products, the cycloidal rolling mill according to the invention will give rise to less friction and permit precise rolling operations to be performed.

The rolling mill can be constructed so that any necessary setting and oscillating movements of the work rolls can be carried out during operation. The construction also permits the work rolls to be periodically swung to and fro during the rolling operation.

Constructional examples of the invention will now be described with reference to the further figures of the accompanying diagrammatic drawings, wherein:

FIG. 8 is a diagram showing a modified arrangement of work roll carrier and associated pressure member;

Figure 10:
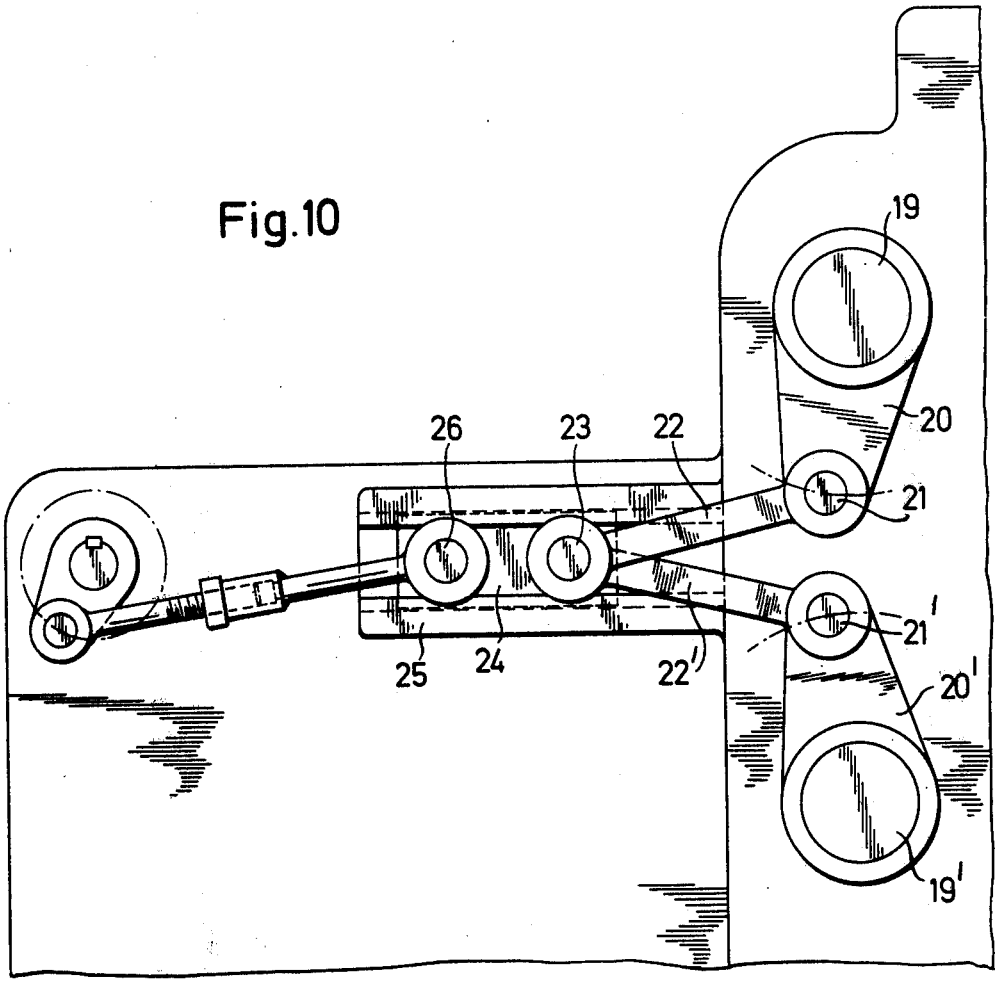
Figure 11:
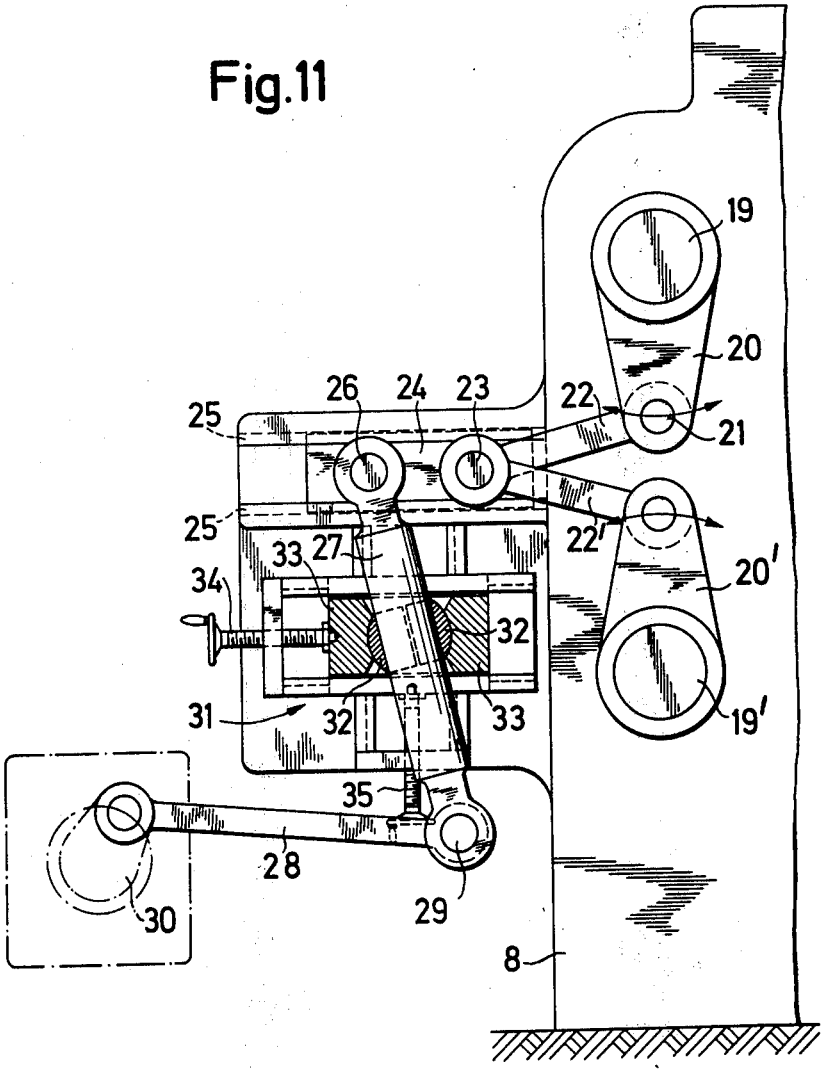
Figure 12:
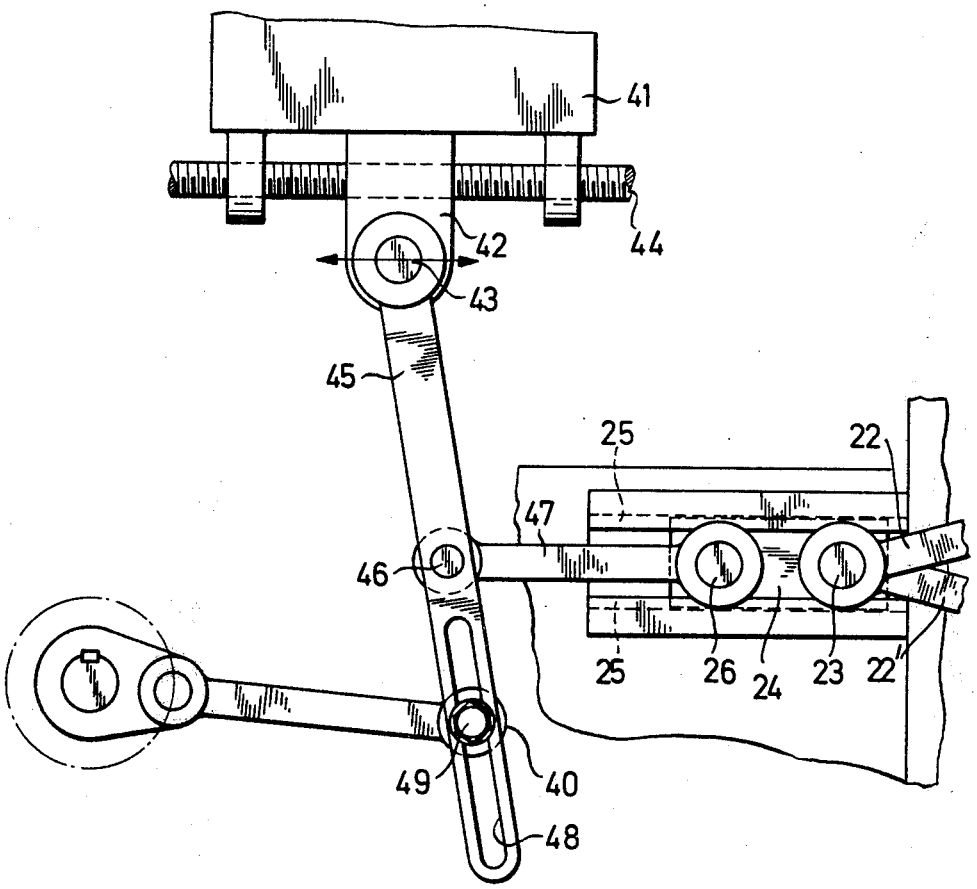
Figure 13C:
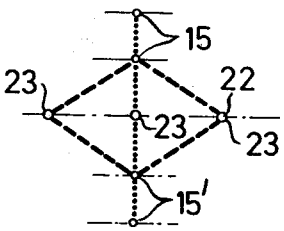
Figure 13B:
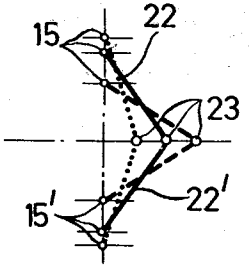
Figure 13A:
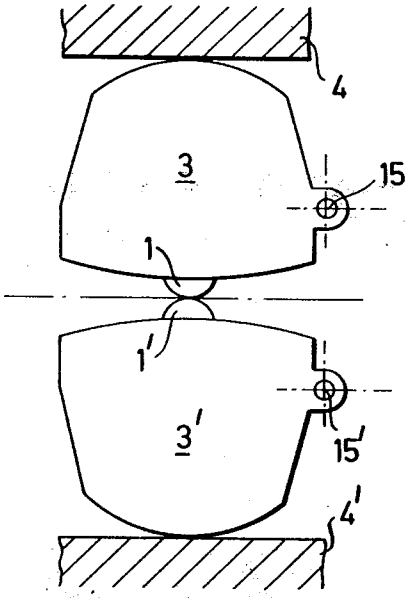

FIGS. 9*a* and 9*b* show still further modifications of work roll carriers and associated pressure members;

FIGS. 10 to 12 illustrate different driving mechanisms for the work roll carriers of the rolling mill, and FIGS. 13*a*, 13*b* and 13*c* are diagrams showing a modification for the synchronous control of the rolling movements of the two work roll carriers.

In all the drawings, the same reference numerals are used for the same or equivalent components.

Figure 1:
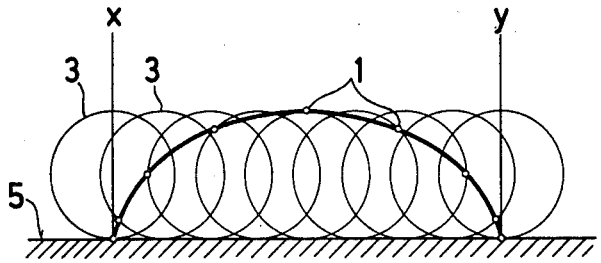
FIGS. 1 to 6 are schematic views showing the operation of the rolls.
Figure 2:
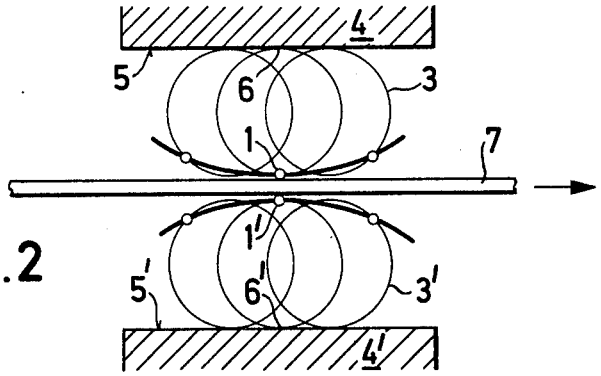
Figure 3:
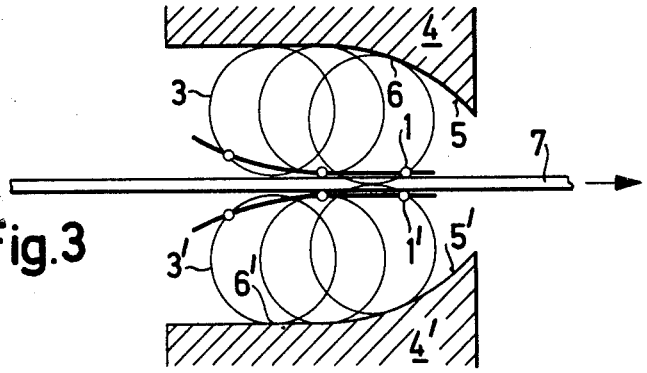
Figure 4:
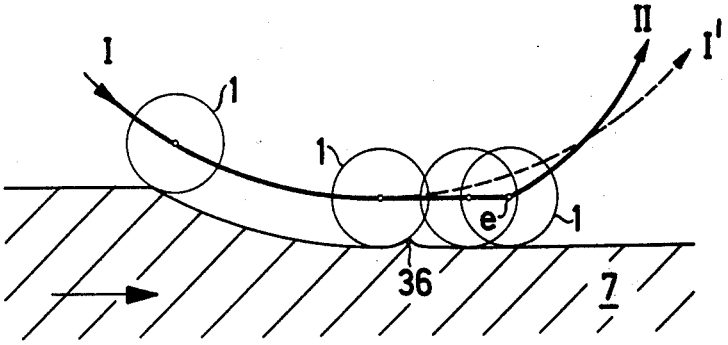
Figure 5:
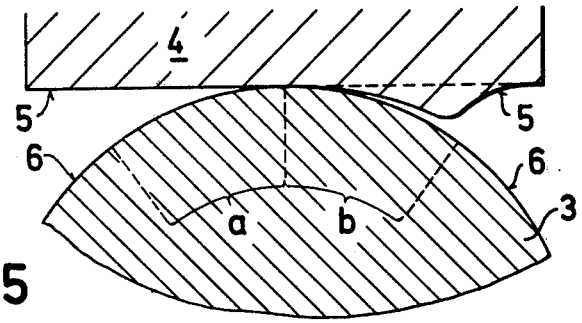
Figure 6:
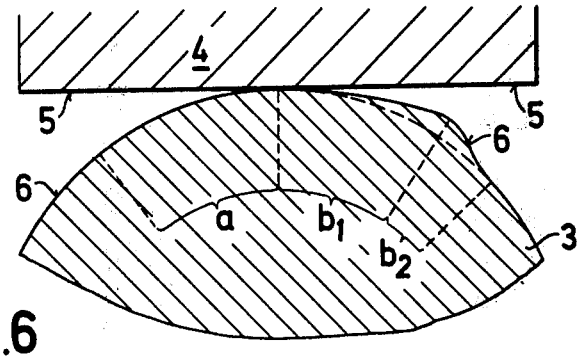
Figure 7:
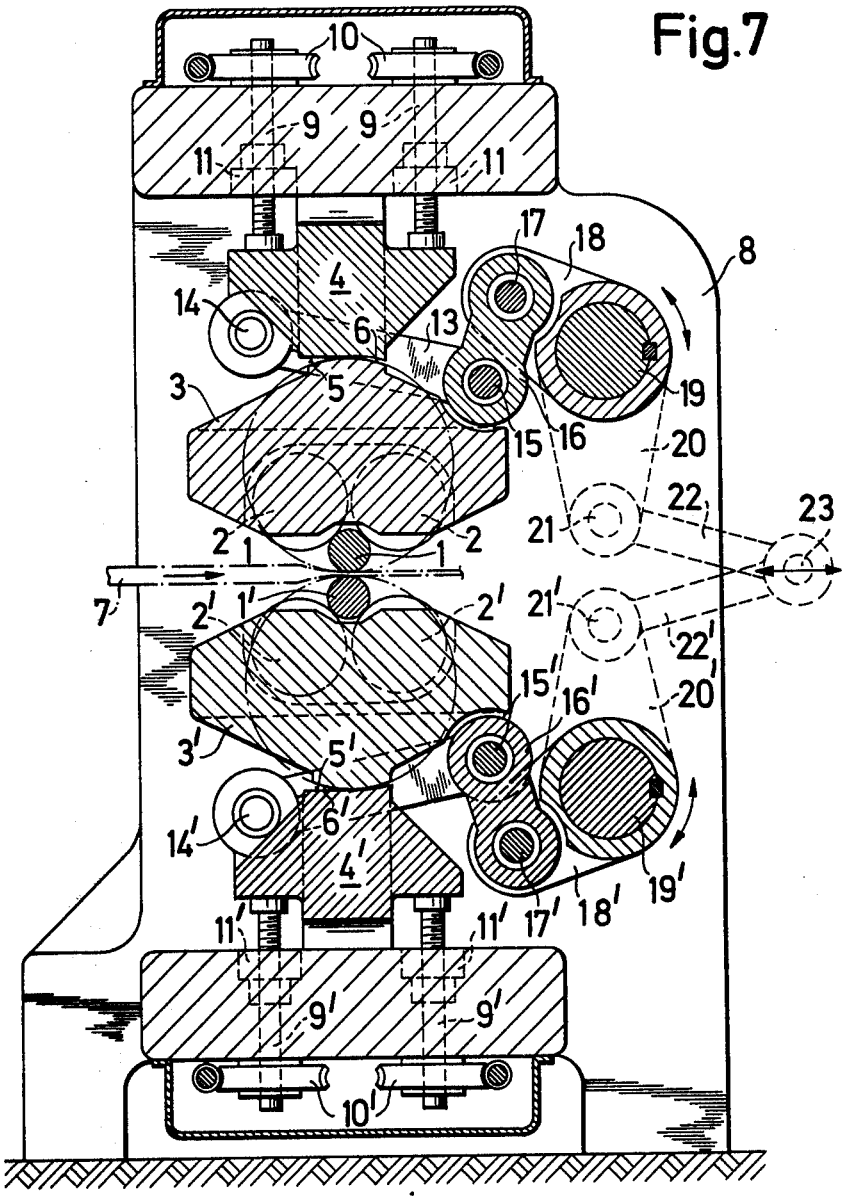
FIG. 7 is a sectional side elevation of a first embodiment.

Referring to FIG. 7, the workpiece 7, which will usually be of strip form, reaches the rolling mill from the left-hand side and passes between the upper work roll 1 and the lower work roll 1'. Each work roll is mounted on a respective rolling member or carrier 3, 3' so that its shaft runs parallel to the geometric central axis of the carrier. It will be seen that the peripheral surface of each work roll carrier is not circular cylindrical throughout and in fact this is not required in practice because only a relatively small fraction of the carrier surface makes rolling contact with the associated pressure member 4, 4'. Accordingly, it is only the portion 6, 6' of each work roll carrier that is circular cylindrical and beyond these portions the contours depart from circular cylindrical. In certain cases even the contacting portions 6, 6' need not be circular cylindrical. However, for ease of reference FIG. 7 shows in chain-dotted lines two circles on which the respective contacting surfaces 6, 6' lie and it is these circles that determine the position of the geometric central axis of the work roll carriers. Each work roll 1, 1' is mounted in its associated carrier so that it makes tangential contact with the aforementioned theoretical circle but it could lie entirely within the circle or project beyond it. In any case, the work roll surface will always form part of the actual carrier surface.

The work rolls 1, 1' are supported by backing rolls 2, 2' which are likewise carried by the carriers 3, 3'. Such backing rolls are preferred but not absolutely essential.

The contacting peripheral surface portions 6, 6' of the work roll carriers are disposed remote from where the work rolls are located and roll on the backing surfaces 5, 5' of the pressure members 4, 4'. These pressure members are effective to press the work rolls against the surfaces of the workpiece 7. In order to ensure that contact is maintained between the surfaces 6, 6' and 5, 5' even when no workpiece is being fed between the work rolls, or when the work rolls happen to be swung away from the workpiece, suitable means are provided, for example springs or tension strips (not shown) which, as viewed from the front of the rolling mill, are stretched to the left and right-hand sides between the carriers 3, 3' and pressure members 4, 4' and pull the surfaces 5, 5' and 6, 6' towards one another.

As viewed in the feeding direction of the workpiece 7, the backing surfaces 5, 5' of the pressure members are planar only along an upstream portion and are then curved towards the workpiece 7. During rolling movement of each work roll carrier, therefore, the work roll describes an upstream path that is cycloidal and a downstream path that is parallel to the workpiece surface.

The elevation of the pressure members 4, 4' is adjustable with the aid of screw-threaded spindles 9, 9' rotatable in nuts 11, 11' fixed in the roll stand 8. The spindles 9, 9' are turned by wormwheels 10, 10' that are splined thereto. There is preferably no rigid connection between the pressure members and spindles so that some tilting or inclination of the pressure members is possible.

Parallel to the geometric central axis of each work roll carrier and rigidly connected to the periphery thereof there is a shaft 15 or 15'. In a manner to be described hereinafter, a motion is applied to the shaft so that the associated work roll carrier is rolled forwards and back over the co-operating pressure member.

To minimize or avoid slip between the surfaces 5, 5' and 6, 6', the pressure members and work roll carriers may be provided with interengaging teeth 12 to each side of the surfaces in question, as shown in FIG. 8. Such teeth permit each work roll to be moved along a predetermined path but may be difficult to form in practice and any play between the teeth could prove disadvantageous. Slip is therefore preferably avoided by the following different means.

Since only a relatively short surface portion of each work roll carrier makes rolling contact with the associated pressure member, the path described by each shaft 15, 15' during rolling of the work roll carrier can be regarded as an arc of a circle of which the centre lies remote from the contacting zone between the work roll carrier and pressure member as viewed from the position of the shaft. It is at this imaginary centre that a shaft 14, 14', parallel to the shafts 15, 15' is fixed to the respective pressure member 4, 4', a guide rod 13 being pivotally mounted on the shafts 14, 15 and another guide rod on the shafts 14', 15'. In this way the spacing between the shafts 14 and 15 is necessarily kept constant during the rolling operation and consequently the contacting surfaces 6, 6' cannot slip on the backing surfaces 5, 5'. This construction employing guide rods 13 is readily executed in practice and most reliable, the difference between the theoretical geometric movement and the actual movement of the work rolls and their carriers being negligible in view of the very short rolling path that is involved. Two guide rods 13 may be provided for each work roll carrier, one on each side, and both pivotally connecting the shafts 14, 15 and 14', 15'.

Yet another method of avoiding slip of the work roll carrier on the pressure member involves the provision of counter-biased flexible tension members such as spring strips, chains, ropes or the like which wind on and off the carriers as the latter are rolled on the pressure members. Such an arrangement is shown for the upper work roll carrier in the respective side elevation and plan view of FIGS. **9*a* and 9*b*. To the right and left-hand sides of the rolling surfaces there are in each case two spring strips 37*a* or 37*b* suitably connected, such as by slots 39*a* or 39*b*, to the work roll carrier 3 and extending in opposite directions to one another to each side of the contacting surface portion 6 along part of the carrier periphery. The strips are held in tension by tension springs 38*a* or 38*b***. They need not be spring strips but could be belts, ropes or the like.

The previously described movement of the shafts 15, 15' effective to cause the work roll carriers to roll on the pressure members is imparted to the shafts 15, 15' by a single reciprocating pin 23 (FIG. 7). The plane of movement of the pin 23 is normal to the plane of the paper. The movement itself is in the direction of the indicated arrows, i.e. from left to right and back again in FIG. 7. One end of each of two connecting rods 22, 22' is rotatably mounted on the pin 23 whilst each other end is connected to a respective pivot 21, 21' of a lever 20, 20' fixed to a shaft 19, 19'. The shafts 19, 19' are rotatably mounted in the roll stand 8 and on each of them there is also fixed a link member 18 or 18' which carries a shaft 17 or 17'. A connecting member 16 is pivoted to the upper shaft 17 by one end whilst its other end is pivoted to the shaft 15. Similarly, a connecting member 16' pivotally connects the lower shafts 17' and 15'.

Reciprocating movement of the pin 23 takes place in a single plane and is converted to oscillating rotary movement of the shaft 19 with the aid of the connecting rod 22, pivot 21 and lever 20. This oscillating rotary movement of the shaft 19 is transmitted through the link member 18, shaft 17, connecting member 16 and shaft 15 to the work roll carrier 3 which is caused to roll to and fro on its associated pressure member 4 and thereby oscillate the work roll 1. Since the same motion of the pin 23 is transmitted to the work roll 1' through the integers 22', 21', 20', 19', 18', 17', 16', 15' and 3', the work rolls will be oscillated in unison and synchronously to one another.

Snychronous oscillation of the work rolls could also be achieved if the connecting rods 22, 22' transmit the reciprocating movement of the pin 23 directly to the shafts 15, 15'. This possibility is illustrated in FIGS. **13*a* to 13*c*. FIG. 13*a* is a diagrammatic representation of the work roll carriers 3, 3' and their associated shafts 15, 15'. Although the path described by the shafts 15, 15' during rolling movement of the work roll carriers is arcuate, it is here being considered as rectilinear for the sake of simplicity, such rectilinear movement taking place along the line joining the centres of the shafts 15, 15'. FIGS. 13*b* and 13*c* show the pin 23** in three positions, namely in the two end positions of its stroke and in a central position.

In FIG. **13*b* the pin 23 is shown in its central position where full lines representing the connecting rods 22, 22' join it to the shafts 15, 15'. In the left-hand end position of the pin 23, the connecting rods assume the position shown in dotted lines whilst in the right-hand end position they are located as shown by the broken lines. The shafts 15, 15' at the ends of the connecting rods are in correspondingly different positions. During the entire stroke of the pin 23, the connecting rods 22, 22' in FIG. 13*b*** extend at an angle to one another which is open to one side (in this case the left-hand side).

In FIG. **13*c* the connecting rods 22, 22' pass through an angle of 180° (dotted line) in the central position of the pin 23. In the left-hand end position of the pin 23, the connecting rods form an angle that is open to the right-hand side and in the right-hand end position of the pin 23** they form an angle that is open to the left-hand side (broken lines).

In the arrangement of FIG. **13*b*, one movement of the pin 23 to and fro causes the shafts 15, 15' to be moved once to and fro whereas in FIG. 13*c* one movement to and fro by the pin 23 causes two movements to and fro by the shafts 15, 15'. Accordingly, in FIG. 13*c* a longer stroke is required for the pin 23 to displace the shafts 15, 15' to the same extent as they are displaced in FIG. 13*b***.

In the FIG. **13*c* arrangement it is of course not absolutely necessary that the connecting rods 22, 22' should extend at 180° to one another just when the pin 23 is at the middle of its reciprocating stroke. The pin 23** should, however, be at this time at a position intermediate the ends of its stroke.

When using gears, racks or like elements for transmitting motion, play cannot be entirely avoided and this gives rise to inaccuracies. In the mechanisms as hereinbefore described, motion is transmitted from the pin 23 to the respective work rolls without employing gear teeth and consequently these mechanisms will operate with a high degree of precision.

If the work rolls 1, 1′ of the rolling mill are to be set or swung occasionally, for example when fluctuations in the thickness or hardness of the workpiece 7 make this necessary, then movement of the pin 23 can be actuated by a suitable measuring and control apparatus. In other words, the pin is moved, and hence the work roll carriers are rolled, at irregular intervals depending on the properties of the workpiece. However, the rolling mill according to the invention is ideally suitable for displacing the work roll carriers 3, 3′ periodically during the rolling operation. For this purpose it is necessary that the pin 23 be reciprocated periodically. This can be effected very simply in practice by mounting the pin 23 in a guide member 24 (FIG. 10) which is slidable to and fro in a guide 25 by means of a connecting rod/crank drive arrangement.

If, with such an arrangement, it is desired to change the length of stroke of the pin 23 or change the location of the stroke (thereby increasing or decreasing the amplitude of oscillation of the work roll carriers or charging the phase of oscillation), then a differently dimensioned connecting rod or crank drive will be necessary. Since replacement of the crank drive and/or connecting rod would mean that the rolling mill must be brought to a standstill, the length and position of the stroke of the pin 23 cannot be varied during the rolling operation.

However, a mechanism will now be described in relation to FIG. 11 that permits adjustment of the stroke of the pin 23 during operation. The pin 23 is in this case provided on a guide member 24 which is slidable in guides 25. These guides 25 may for example be grooves in a structural component that is fixed to the roll stand 8 or which forms part of the roll stand. The guide member 24 carries a further pin 26 to which one end of a swing arm 27 is pivoted. The other end of the swing arm 27 is connected by a pivot 29 to one end of a connecting rod 28 of which the other end is seated on a crank drive 30.

By reason of the linear guiding of the guide member 24, the end of the swing arm 27 mounted on the pin 26 will also describe a linear path. For this reason the central portion of the swing arm 27 cannot be supported by a fixed pivot: otherwise the end seated on the pin 26 would describe an arcuate path. Accordingly, the central portion of the swing arm 27 is provided with a special 'momentary pivotal bearing' 31.

As the end of the swing arm 27 seated on the connecting rod 28 moves from right to left, the other end of the swing arm on the pin 26 is moved from left to right. Since the upper end of the swing arm cannot describe an arcuate path, the actual pivotal point of the swing arm 27 varies from one instant to the next or from one moment to the next. The momentary pivotal bearing 31 therefore serves to support the swing arm 27 no matter where the pivotal point of the matter may be at any one instant. It comprises sliding jaws 32 having planar faces between which the swing arm 27 can slide and convex arcuate surfaces which are seated in concave bearings 33. The momentary pivotal bearing 31 is vertically adjustable on the roll stand 8 by means of a spindle 35 whilst a spindle 34 permits horizontal adjustment. If the momentary pivotal bearing 31 in FIG. 11 is moved up or down, the stroke of the pin 23 is correspondingly shortened or lengthened and thus the work roll carrier 3 or 3′ is rolled along a shorter or longer path, repectively. If the bearing 31 is adjusted horizontally, this results in a displacement of the reciprocating stroke of the pin 23 and consequently a displacement of the rolling path of the work roll carrier. Horizontal as well as vertical adjustment of the bearing 31 is possible without bringing the entire rolling mill to a standstill.

Another embodiment of a mechanism for reciprocating the pin 23 periodically is shown in FIG. 12. One end of a connecting link 47 is rotatably mounted on the pin 26 and the other end on a pivot 46 at the centre of a swing arm 45. One end of this swing arm 45 is rotatable about a pivot 43 and the other end is moved by a connecting rod and crank drive acting through a pivot 40. The pivot 43 is preferably disposed in a bearing block 42 that is displaceable along a carrier 41 by any suitable means such as a spindle 44. The carrier 41 is fixed to the roll stand 8. Displacement of the pivot 43 by adjusting the bearing block 42 gives rise to displacement of the stroke of the pin 23 or displacement of the region over which the work roll carrier rolls, without bringing the rolling mill to a standstill.

At the end of the swing arm 45 remote from the pivot 43, the pivot 40 for the connecting rod is preferably adjustable. Such adjustment, which can for example be effected with the aid of a slot 48 in the swing arm 45 with the aid of a locking screw 49, causes the length of the stroke of the pin 23 to be increased or decreased and thus the rolling path of the work roll carrier to be increased or decreased without the need for replacing any of the machine components by different components.

The rolling mill according to the invention can be constructed more simply and cheaply than known mills of the same output and with smaller dimensions.

We claim:

1. A cycloidal rolling mill for reducing the thickness of a metal workpiece, comprising:

at least one rotary work roll located to be above the workpiece and one rotary work roll located to be below the workpiece, said work rolls being adapted to be engaged on the workpiece;

a displaceable carrier associated with each of said work rolls, each displaceable carrier comprising a curved cam surface which faces away from the work roll;

means for supporting said work rolls on said displaceable carriers;

means for moving said displaceable carriers in a forward advance direction and in the opposite direction while said work rolls are simultaneously engaged on the upper and underside surfaces of the workpiece; and backing members associated with each displaceable carrier for maintaining a predetermined separation between said displaceable carriers to maintain a corresponding predetermined spacing between said work rolls when the workpiece is fed therebetween so that said work rolls are engaged against the workpiece during said forward advance of said displaceable carriers as well as during movement of said displaceable carriers in said opposite direction to perform a rolling operation on the workpiece, each backing member including a counterface on which the cam surface of each displaceable carrier engages, said engaging cam surfaces and said counterfaces being shaped to cause said displaceable carriers with said work rolls supported thereon to follow a path including a cycloidal portion and a rectilinear portion during movement of said displaceable carriers in said forward and opposite directions.

2. A rolling mill according to claim 1, wherein each cam surface is arcuate and each counterface has a substantially planar trailing surface portion and a curved leading surface portion as viewed in the direction of workpiece travel.

3. A rolling mill according to claim 2, wherein the leading surface portions of the counterfaces are curved so as to be directed towards one another and then away from one another.

4. A rolling mill according to claim 1, wherein each backing member has a substantially planar counterface and each cam surface has leading and trailing surface portions of differing curvature.

5. A rolling mill according to claim 4, wherein the leading cam surface portion, as viewed in the direction of workpiece travel, has a first portion which is more shallowly curved than the trailing cam surface portion and a second portion which is more intensely curved than the trailing cam surface portion.

6. A rolling mill according to claim 1, wherein the leading ends of the cam surfaces, as viewed in the direction of workpiece travel, are disposed on the carriers so that, when the leading ends roll on the respective counterfaces, the work rolls make contact with the workpiece but do not effect a reduction in thickness thereof.

7. A rolling mill according to claim 1, wherein each carrier is provided with rotary backing rolls for supporting the work roll.

8. A rolling mill according to claim 1, wherein the backing members are fixed in a frame but are adjustable in position towards and away from one another.

9. A rolling mill according to claim 8, wherein the backing members are tiltable.

10. A rolling mill according to claim 1, including interengaging teeth on each carrier and associated backing member disposed beyond the cam surface and counterface, whereby to avoid slip of each carrier as its cam surface rolls on the counterface.

11. A rolling mill according to claim 1, including a shaft fixed to the periphery of each carrier and associated backing member and a guide roll pivotally mounted on each shaft, whereby to avoid slip of each carrier as its cam surface rolls on the counterface.

12. A rolling mill according to claim 1, including counter-biassed flexible tension members disposed to both sides of the counterface of each backing member and arranged to be wound on and off the respective carriers during displacement thereof, whereby to minimize slip of each carrier as its cam surface rolls on the counterface.

13. A rolling mill according to claim 12 including synchronous control means for the work roll carriers so as to insure that the two work rolls are displaced in unison, said synchronous control means comprising a pin which is reciprocatable in a single plane.

14. A rolling mill according to claim 13, wherein reciprocating movement of the pin is transmitted to both roll carriers by a respective connecting rod hinged to the pin and to one end of a lever, a shaft on which the other end of the lever and a link member are mounted, and a connecting member pivoted to the link member and the carrier.

15. A rolling mill according to claim 13, wherein reciprocating movement of the pin is transmitted direct to both roll carriers by a respective connecting rod hinged to the pin and the said shaft at the periphery of the carrier.

16. A rolling mill according to claim 15, wherein the connecting rods are dimensioned and arranged so that along the entire reciprocating path of the pin they extend at an angle to one another that is open towards one side.

17. A rolling mill according to claim 15, wherein the connecting rods are dimensioned and arranged so that in one position of the pin intermediate the limits of its reciprocating movement they pass through an angle of 180°.

18. A rolling mill according to claim 1 adapted so that the carriers roll on the counterfaces periodically.

19. A rolling mill according to claim 13, wherein the pin is reciprocatable periodically.

20. A rolling mill according to claim 19, wherein the pin is positively connected to a guide member which is slidable within a guide by means of a further connecting rod and a crank drive acting through a further pin.

21. A rolling mill according to claim 20, wherein one end of a swing arm is pivoted to the further pin, the other end of the swing arm is hinged to the further connecting rod, and the further connecting rod is coupled to the crank drive, a momentary pivotal bearing being provided intermediate the ends of the swing arm.

22. A rolling mill according to claim 21, wherein the momentary pivotal bearing comprises circular segmental slide jaws between the planar faces of which the swing arm is slidingly received, and wherein the arcuate faces of the slide jaws are rotatable between supporting members.

23. A rolling mill according to claim 22, wherein the momentary pivotal bearing is adjustably positioned.

24. A rolling mill according to claim 20, wherein one end of a connecting link is rotatably mounted on the further pin, the other end of the connecting link being pivoted to intermediate the ends of a swing arm of which one end is pivoted to a bearing and the other end is displaceable by the further rod and crank drive acting through a pivot.

25. A rolling mill according to claim 24, wherein the bearing is located in a bearing block which is displaceable along a support.

26. A rolling mill according to claim 25, wherein the pivot is adjustable in position along the swing arm.

27. A rolling mill according to claim 2, wherein the pivot is displaceable in a slot of the swing arm and can be locked in position by a locking screw.

28. A rolling mill in accordance with claim 1 wherein said work rolls are rotatably mounted in associated displaceable carriers in the form of rolling members, wherein each work roll is mounted in its associated rolling member so that its rotary axis is parallel to the geometric central axis of the rolling member and its peripheral surface forms a continuation of the periphery of the rolling member, and wherein a peripheral surface portion of each rolling member opposite to where the work roll is located is disposed to roll on a backing surface of a pressure member for urging the respective work roll against the workpiece during the rolling operation.

29. A rolling mill according to claim 28 wherein each backing surface and peripheral surface portion of the rolling member is shaped according to the desired nature of rolling the workpiece.

30. A process for reducing the thickness of a workpiece, comprising the steps of:

feeding the workpiece in a forward direction into a rolling mill having work rolls and an entrance and an exit;

engaging said work rolls on opposite faces of said workpiece as the workpiece enters said rolling mill to reduce the thickness of the workpiece and to smooth the workpiece opposite faces;

moving said work rolls in said forward direction along a cycloidal path to reduce the thickness of the workpiece to a predetermined location where said work rolls no longer exert thickness reducing pressure on the workpiece;

moving said work rolls from said location in said forward direction along a rectilinear path while maintaining said work rolls in engagement with the workpiece until said exit to smooth the workpiece opposite faces uniformly;

moving said work rolls along said rectilinear path in a reverse direction until said work rolls reach said location to smooth the workpiece opposite faces; and moving said work rolls along said cycloidal path in said reverse direction to a location adjacent said rolling mill inlet.

31. The method of claim 30 wherein the step of moving said work rolls in a cycloidal path includes steps of rotating said work rolls in the workpiece feed direction and rotating said work rolls in a direction opposite to said workpiece feed direction.

* * * * *